US009493708B2

(12) United States Patent
Nakamura et al.

(10) Patent No.: US 9,493,708 B2
(45) Date of Patent: Nov. 15, 2016

(54) PROCESS FOR PRODUCING CAKING ADDITIVE FOR COKE PRODUCTION AND PROCESS FOR PRODUCING COKE

(75) Inventors: Yoshikazu Nakamura, Tokyo (JP); Takushi Nagashima, Tokyo (JP); Kenjiro Matsuoka, Tokyo (JP); Kouichi Inoue, Ayauta-gun (JP); Daisuke Anraku, Tokyo (JP)

(73) Assignees: JX NIPPON OIL & ENERGY CORPORATION, Tokyo (JP); MITSUBISHI CHEMICAL CORPORATION, Tokyo (JP)

( * ) Notice: Subject to any disclaimer, the term of this patent is extended or adjusted under 35 U.S.C. 154(b) by 947 days.

(21) Appl. No.: 13/138,332

(22) PCT Filed: Feb. 3, 2010

(86) PCT No.: PCT/JP2010/000655
§ 371 (c)(1),
(2), (4) Date: Aug. 1, 2011

(87) PCT Pub. No.: WO2010/090013
PCT Pub. Date: Aug. 12, 2010

(65) Prior Publication Data

US 2011/0284424 A1 Nov. 24, 2011

(30) Foreign Application Priority Data

Feb. 3, 2009 (JP) ..... 2009-023053

(51) Int. Cl.
*C10C 3/08* (2006.01)
*C10G 21/14* (2006.01)
(Continued)

(52) U.S. Cl.
CPC ..... *C10C 3/08* (2013.01); *C10B 55/02* (2013.01); *C10G 9/005* (2013.01); *C10G 21/003* (2013.01); *C10G 21/14* (2013.01); *C10G 35/00* (2013.01); *C10G 35/04* (2013.01); *C10G 57/00* (2013.01); *C10G 2300/107* (2013.01); *C10G 2300/1077* (2013.01); *C10G 2300/80* (2013.01)

(58) Field of Classification Search
CPC .... C10G 9/005; C10G 21/003; C10G 21/14; C10C 3/08
USPC ..... 208/22, 45
See application file for complete search history.

(56) References Cited

FOREIGN PATENT DOCUMENTS

| | | |
|---|---|---|
| CN | 1493652 | 5/2004 |
| JP | 56-118486 | 9/1981 |

(Continued)

OTHER PUBLICATIONS

Derwent Abstract of JP 59-179586 (JP 59-179586 published Oct. 1984).*

(Continued)

*Primary Examiner* — Renee E Robinson
(74) *Attorney, Agent, or Firm* — Andrews Kurth Kenyon LLP

(57) ABSTRACT

A process for producing a caking additive for coke production, the process including a step of extracting a solvent deasphalted pitch that can be used as a caking additive for coke production from a residue containing at least one of an atmospheric residue obtained by atmospheric distillation of a crude oil and a vacuum residue obtained by atmospheric distillation and vacuum distillation of a crude oil, wherein the extraction is performed using, as a solvent, a light reformate obtained by catalytic reforming a naphtha fraction that is fractionated from a crude oil by atmospheric distillation of the crude oil.

11 Claims, 1 Drawing Sheet

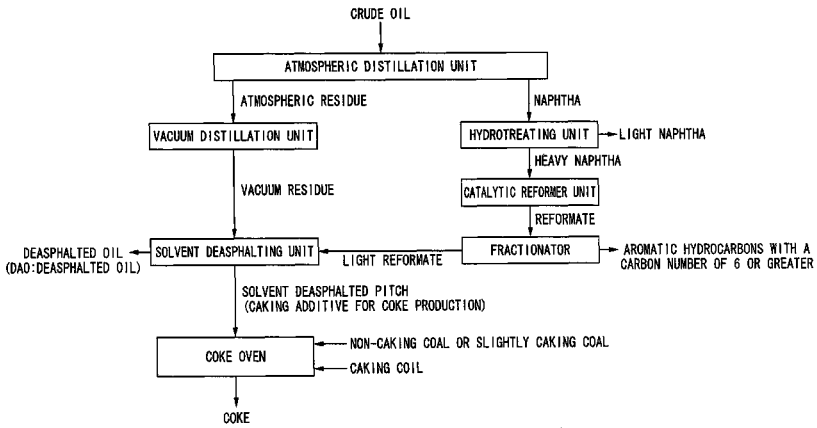

(51) Int. Cl.

| | |
|---|---|
| ***C10G 9/00*** | (2006.01) |
| ***C10G 21/00*** | (2006.01) |
| ***C10G 35/00*** | (2006.01) |
| ***C10G 35/04*** | (2006.01) |
| ***C10G 57/00*** | (2006.01) |
| ***C10B 55/02*** | (2006.01) |

(56) References Cited

FOREIGN PATENT DOCUMENTS

| | | |
|---|---|---|
| JP | 56-139589 | 10/1981 |
| JP | 59-179586 | 10/1984 |
| JP | 02-016356 | 4/1990 |
| JP | 2004-513214 | 4/2004 |
| JP | 2006-291190 | 10/2006 |
| JP | 2007-321067 | 12/2007 |
| WO | WO 02/36718 | 5/2002 |

OTHER PUBLICATIONS

English Translation of JP 59-179586, translated Jun. 2014.*
International Search Report dated Mar. 9, 2010 issued in corresponding PCT Application No. PCT/JP2010/000655.
Development of Optical Anisotropic Texture Structure according to Reaction of Co-Carbonization of Carbon "Tansokakogaku no kiso" (Principles of Carbonization Engineering), Sugiro Otani, Yuzo Sanada, published by Ohmsha, Ltd., pp. 222 to 226.
Notice of Allowance dated Jul. 27, 2010 issued in corresponding Japanese Application No. 2009-023053.
Chinese Office Action dated Mar. 15, 2013, issued in corresponding Chinese Application No. 201080006350.9.
Office Action dated Aug. 19, 2015 issued in corresponding Korean Application No. 10-2011-7020144 [with English Translation].

* cited by examiner

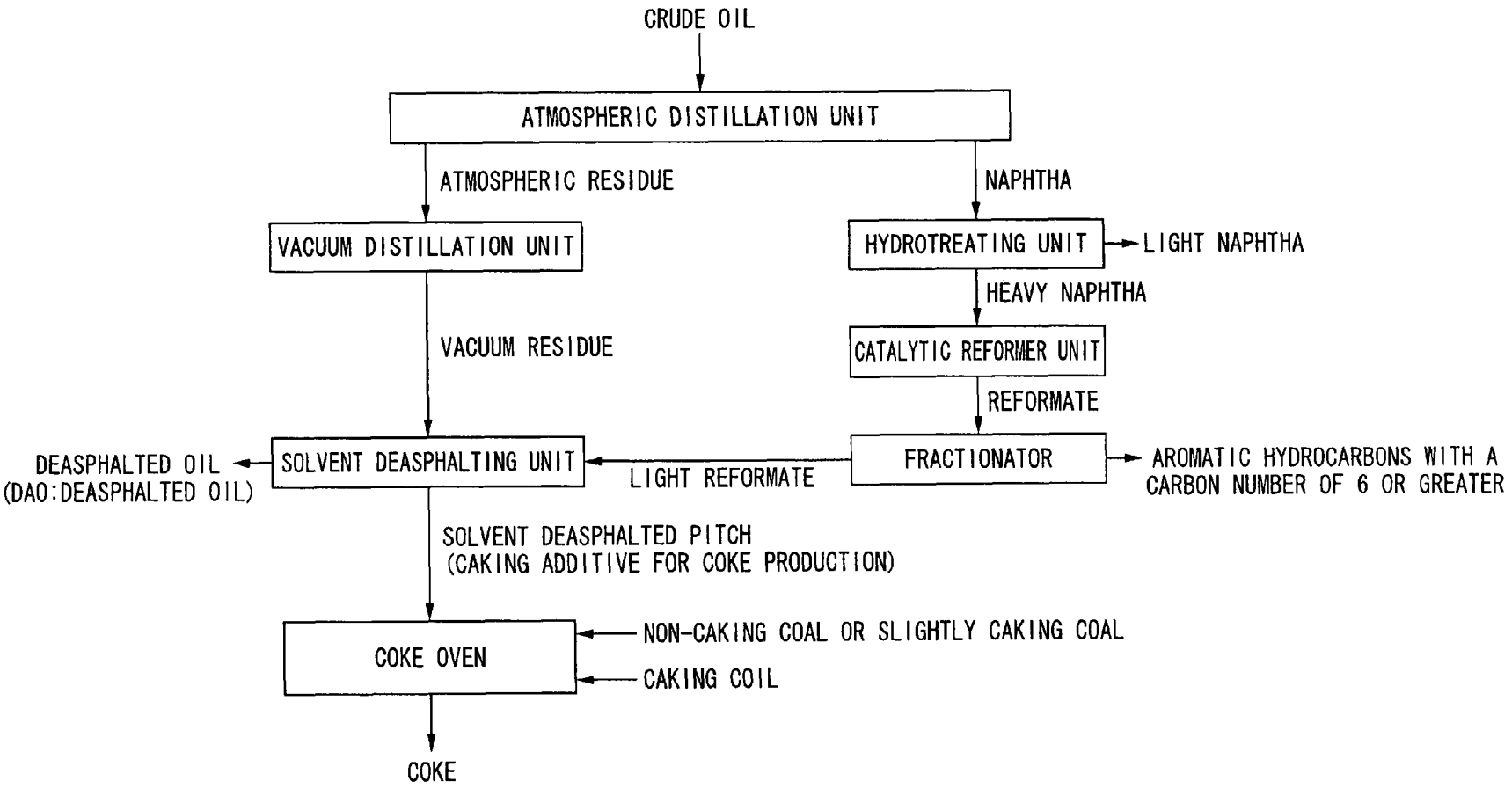
CRUDE OIL
ATMOSPHERIC DISTILLATION UNIT
NAPHTHA
ATMOSPHERIC RESIDUE
HYDROTREATING UNIT
LIGHT NAPHTHA
HEAVY NAPHTHA
CATALYTIC REFORMER UNIT
REFORMATE
FRACTIONATOR
AROMATIC HYDROCARBONS WITH A CARBON NUMBER OF 6 OR GREATER
LIGHT REFORMATE
VACUUM DISTILLATION UNIT
VACUUM RESIDUE
SOLVENT DEASPHALTING UNIT
DEASPHALTED OIL (DAO:DEASPHALTED OIL)
SOLVENT DEASPHALTED PITCH (CAKING ADDITIVE FOR COKE PRODUCTION)
NON-CAKING COAL OR SLIGHTLY CAKING COAL
CAKING COIL
COKE OVEN
COKE

PROCESS FOR PRODUCING CAKING ADDITIVE FOR COKE PRODUCTION AND PROCESS FOR PRODUCING COKE

This application is a national stage application of International Application No. PCT/JP2010/000655, filed Feb. 3, 2010, which claims priority to Japanese Patent Application No. 2009-23053, filed Feb. 3, 2009, the content of which is incorporated herein by reference.

TECHNICAL FIELD

The present invention relates to a process for producing a caking additive for coke production and a process for producing coke, and relates particularly to a process for producing a caking additive for coke production that is obtained using crude oil as a raw material and a process for producing coke.

Priority is claimed on Japanese Patent Application No. 2009-23053, filed Feb. 3, 2009, the content of which is incorporated herein by reference.

BACKGROUND ART

Blast furnace coke is essential in blast furnace operations, as a heat source for melting mineral ores, as a reducing agent for reducing iron ore to obtain iron, and as a high temperature resistant support material for maintaining gas permeability and melt permeability within the blast furnace. Accordingly, the coke requires sufficiently high strength to withstand the pressure of the packed bed inside the blast furnace while achieving a high degree of porosity, and must have a high level of abrasion resistance that satisfactorily minimizes the generation of fine powder. In order to produce this type of coke that exhibits superior strength and abrasion resistance and is capable of maintaining favorable porosity, not less than a certain proportion of a strongly caking coal is preferably included within the raw material coal used for coke production. However, there are limitations on the production of such strongly caking coal in terms of the production locality, quantity and cost, and it is anticipated that resource depletion may also become problematic in the near future. Consequently, it is desirable to reduce the amount of strongly caking coal within the raw material coal used for coke production.

Crude oil is generally subjected to atmospheric distillation during the refining process, thereby fractionating the crude oil into gas, LPG, naphtha, kerosene, light gas oil, heavy gas oil, and an atmospheric residue.

The naphtha, which is separated from the other components such as the atmospheric residue by performing an atmospheric distillation of the crude oil, is usually subjected to removal of the sulfur component within a hydrotreating unit, and subsequently separated into a light naphtha and a heavy naphtha. The heavy naphtha is reformed in a catalytic reformer unit, generating a reformate containing mainly aromatic hydrocarbons. Subsequently, the reformate is separated by a fractionator into a light reformate containing mainly hydrocarbons with a carbon number of 5 and a fraction containing mainly aromatic hydrocarbons with a carbon number of 6 or greater.

Further, the atmospheric residue that is separated from the other components by performing an atmospheric distillation of the crude oil is usually subjected to subsequent distillation under reduced pressure using a vacuum distillation unit. The vacuum residue that is separated from the other components by subjecting the atmospheric residue to a vacuum distillation is then further purified using a solvent extraction process known as an SDA (Solvent Deasphalting) process, a thermal decomposition process such as the Eureka Process or a coker process, or some other form of process.

In the SDA process of a vacuum residue, a solvent is used to selectively separate and remove the maltene fraction composed of the comparatively low molecular weight oils and resins that constitute the vacuum residue, while the asphaltenes having alkyl side chains and hydrogens contained within the vacuum residue are concentrated, thus producing a viscous SDA pitch.

Furthermore, when a thermal decomposition process is performed on the vacuum residue, thermal decomposition reactions of the vacuum residue cause a separation into a light oil having a high hydrogen content and a petroleum pitch having a high carbon content and high softening point such as Eureka pitch. When the vacuum residue is subjected to the thermal decomposition process, a dehydrogenation reaction occurs, and the side chains of the asphaltenes contained within the vacuum residue undergo dealkylation via a thermal decomposition reaction. Accordingly, the asphaltenes contained within the petroleum pitch are modified forms of the asphaltenes contained within the vacuum residue, and are typically highly aromatic compounds that have undergone polycondensation.

Conventionally, a caking additive for coke production formed from a petroleum pitch such as Eureka pitch is added to the raw material coal during the production of coke for iron production, and it is known that this addition enables the blend proportion of non-caking coal or slightly caking coal within the raw material coal to be increased. Further, coke production caking additives in which the modification of the asphaltenes is minimal and for which the co-carbonization reaction with coal readily generates optically anisotropic structures are preferred, and by using such caking additives, the strength of the coke can be increased, and the blend proportion of non-caking coal or slightly caking coal can be increased (see Non-Patent Document 1).

Examples of coke production caking additives that employ crude oil as the raw material include the caking additives disclosed in Patent Documents 1 to 4.

Patent Document 1 discloses a technique in which a deasphalted asphalt having a softening point of not less than 100° C., which is obtained from a petroleum-based heavy oil using butane, pentane or hexane, either alone or within a mixture, as a solvent, is added and blended as a caking additive.

Patent Document 2 discloses a process for producing an artificial caking coal in which a deasphalted asphalt extracted using butane, pentane or hexane as a solvent is reformed by heat treatment.

Further, Patent Document 3 discloses a caking filler containing more than 20% but not more than 90% of a hexane-soluble component and not more than 1% of a toluene-insoluble component, wherein the remainder is composed of a component that is insoluble in hexane and soluble in toluene, and an unavoidable residue component.

Furthermore, Patent Document 4 discloses a process for producing a caking additive for coke production, the process including a first step of separating a light oil from a petroleum-based heavy oil by solvent extraction or a distillation treatment to obtain a petroleum pitch, a second step of subjecting the petroleum pitch to a hydrogenation reforming treatment to obtain a reformed material, and a third step of separating the reformed material into a light oil and a heavy residue by solvent extraction or a distillation extraction.

PRIOR ART DOCUMENTS

Patent Documents

[Patent Document 1] Japanese Unexamined Patent Application, First Publication No. S 59-179586

[Patent Document 2] Japanese Unexamined Patent Application, First Publication No. S 56-139589

[Patent Document 3] Japanese Unexamined Patent Application, First Publication No. 2006-291190

[Patent Document 4] Japanese Unexamined Patent Application, First Publication No. 2007-321067

Non-Patent Documents

[Non-Patent Document 1] "Tansokakogaku no kiso" (Principles of Carbonization Engineering), Sugiro Otani, Yuzo Sanada, published by Ohmsha, Ltd., pp. 222 to 226.

DISCLOSURE OF INVENTION

Problems to be Solved by the Invention

However, the caking additive disclosed in Patent Document 1 has a low softening point and contains a large amount of light paraffin, and therefore has a large volatile matter making it undesirable for use as a caking additive for coke production.

Further, in the artificial caking coal disclosed in Patent Document 2, because the deasphalted asphalt is reformed by heat treatment, the asphaltenes are modified, and when the reformed asphalt is used as a caking additive for coke production, the development of optically anisotropic structures during the co-carbonization reaction with coal is not able to be promoted sufficiently, which tends to limit the effect of the additive in increasing the strength of the coke, making it difficult to satisfactorily increase the proportion of non-caking coal or slightly caking coal.

Further, as described below, with all of the conventional techniques it has proven difficult to produce, with good yield, a favorable caking additive for coke production that has a minimal volatile matter and is able to effectively increase the coke strength.

In other words, in order to obtain a caking additive for coke production that is capable of effectively increasing the coke strength, it is thought that a solvent extraction process rather than a thermal decomposition process should be used as the process for refining the vacuum residue in order to prevent modification of the asphaltenes by thermal decomposition reactions. Further, in the solvent extraction process, the heavier the solvent used, the smaller the volatile matter of the obtained caking additive for coke production becomes, with the molecular structure of the resulting caking additive for coke production becoming a highly aromatic structure similar to the unit structure of coal, which is preferred in terms of effectively increasing the strength of the coke. Accordingly, it is thought that in order to obtain a favorable caking additive for coke production having a minimal volatile matter, a hydrocarbon such as butane or pentane that is heavier (has a larger molecular weight) than the propane typically used in the SDA process should be used as the solvent in the solvent extraction process.

However, even in those cases where butane, which is a heavier hydrocarbon than propane, is used as the solvent, the resulting caking additive for coke production still contains a large amount of light paraffin having a low softening point, and therefore the additive still does not have a sufficiently small volatile matter. Accordingly, in order to obtain a favorable caking additive for coke production having a minimal volatile matter, a hydrocarbon that is even heavier than butane must be used as the solvent. However as the solvent that is used becomes heavier, the viscosity and softening point of the resulting caking additive for coke production increase, and therefore it becomes more difficult to extract the caking additive for coke production from the solvent deasphalting unit, and the productivity and yield of the caking additive for coke production tend to deteriorate.

The present invention takes the above circumstances into consideration, with an object of providing a process for producing a caking additive for coke production that enables the production, with good yield, of a favorable caking additive for coke production that has a minimal volatile matter and is able to effectively increase the coke strength.

Further, another object of the present invention is to provide a process for producing coke in which, by using a raw material coal for coke production that includes the caking additive for coke production according to the present invention, a large amount of non-caking coal or slightly caking coal can be added to the raw material coal for coke production, and yet a high-strength coke can still be obtained.

Means to Solve the Problems

A process for producing a caking additive for coke production according to the present invention includes a step of extracting a solvent deasphalted pitch that can be used as a caking additive for coke production from a residue containing at least one of an atmospheric residue obtained by atmospheric distillation of a crude oil and a vacuum residue obtained by atmospheric distillation and vacuum distillation of a crude oil, wherein the extraction is performed using, as a solvent, a light reformate obtained by catalytic reforming a naphtha fraction that is fractionated from a crude oil by atmospheric distillation of the crude oil.

In the process for producing a caking additive for coke production according to the present invention, the extraction of the solvent deasphalted pitch may be performed at an extraction temperature of 150 to 200° C., using a flow rate ratio of the solvent relative to the residue (solvent/oil ratio) within a range from 5/1 to 8/1.

In the process for producing a caking additive for coke production according to the present invention, the softening point of the solvent deasphalted pitch may be within a range from 140 to 200° C., and the amount of carbon residue within the solvent deasphalted pitch may be within a range from 30 to 70% by mass.

A caking additive for coke production according to the present invention is obtained using the production process described above, has a softening point within a range from 140 to 200° C., an amount of carbon residue (carbon residue) within a range from 30 to 70% by mass, and an atomic ratio of hydrogen to carbon (H/C) of not more than 1.2.

A process for producing coke according to the present invention includes a step of extracting a solvent deasphalted pitch that can be used as a caking additive for coke production from a residue containing at least one of an atmospheric residue obtained by atmospheric distillation of a crude oil and a vacuum residue obtained by atmospheric distillation and vacuum distillation of a crude oil, wherein the extraction is performed using, as a solvent, a light reformate obtained by catalytic reforming a naphtha fraction that is fractionated from a crude oil by atmospheric distillation of the crude oil, and a step of producing a coke by performing dry distillation of a raw material coal for coke production that contains the solvent deasphalted pitch.

In the process for producing coke according to the present invention, the raw material coal for coke production may contain 0.5 to 10% by mass of the solvent deasphalted pitch.

In the process for producing coke according to the present invention, the raw material coal for coke production may contain 10 to 50% by mass of non-caking coal or slightly caking coal.

Effect of the Invention

With the process for producing a caking additive for coke production according to the present invention, unlike thermal decomposition processes, modification of the asphaltenes due to thermal decomposition reactions does not occur. Further, compared with Eureka pitch and the like, a superior caking additive for coke production that enables the coke strength to be effectively increased can be obtained.

Furthermore, in the process for producing a caking additive for coke production according to the present invention, because the solvent deasphalted pitch is extracted from the residue using a light reformate as the solvent, the volatile matter within the solvent deasphalted pitch is less than the case where butane is used as the solvent, and the solvent deasphalted pitch is more readily extracted from the solvent deasphalting unit than the case where hexane is used as the solvent. Accordingly, a favorable caking additive for coke production can be produced with good yield.

Furthermore, according to the process for producing coke of the present invention, a large amount of non-caking coal or slightly caking coal can be added to the raw material coal for coke production, and yet a high-strength coke can be obtained, and therefore the amount of strongly caking coal within the raw material coal for coke production can be reduced.

BRIEF DESCRIPTION OF THE DRAWINGS

FIG. 1 is a flowchart describing one example of the process for producing a caking additive for coke production and the process for producing coke according to the present invention.

BEST MODE FOR CARRYING OUT THE INVENTION

More detailed descriptions of the process for producing a caking additive for coke production and the process for producing coke according to the present invention are presented below.

FIG. 1 is a flowchart describing one example of the process for producing a caking additive for coke production and the process for producing coke according to the present invention. In the production process of the embodiment illustrated in FIG. 1, a solvent deasphalted pitch that can be used as a caking additive for coke production is extracted from a residue in a solvent deasphalting unit using a light reformate as the solvent.

As illustrated in FIG. 1, in this embodiment, an atmospheric residue is obtained by subjecting a crude oil to atmospheric distillation in an atmospheric distillation unit used in a crude oil refining process. A vacuum residue is then obtained by subjecting this atmospheric residue to vacuum distillation in a vacuum distillation unit. The vacuum residue obtained in this manner is used as the raw material for a solvent deasphalted pitch.

In terms of the residue used as the raw material for the solvent deasphalted pitch, the vacuum residue obtained by atmospheric distillation and vacuum distillation of the crude oil may be used, as illustrated in FIG. 1, or alternatively, the atmospheric residue obtained by atmospheric distillation of the crude oil, or a mixture of the vacuum residue and the atmospheric residue, may be used.

Furthermore, in this embodiment, as illustrated in FIG. 1, the light reformate used as the solvent is obtained by subjecting the crude oil to atmospheric distillation to obtain a naphtha fraction, reforming that naphtha fraction in a catalytic reformer unit, and then separating the light reformate from the other components. More specifically, the light reformate is obtained using the procedure described below.

First, the crude oil that functions as the raw material is fractionated using the atmospheric distillation unit shown in FIG. 1, thus yielding a naphtha fraction (a fraction containing mainly compounds with a boiling point of 30 to 230° C.). The naphtha fraction may be fractionated into a light naphtha fraction (for example, corresponding with boiling points of 30 to 90° C.) and a heavy naphtha fraction (for example, corresponding with boiling points of 80 to 180° C.) using the atmospheric distillation unit, with these fractions subsequently subjected to hydrotreating (hydrodesulfurization), or the naphtha fraction may be first treated in a hydrotreating (hydrodesulfurization) unit, and subsequently fractionated into a light naphtha and a heavy naphtha.

Next, the heavy naphtha (containing mainly compounds with a boiling point of 80 to 180° C.) is reformed in a catalytic reformer unit to prepare a reformate containing mainly aromatic hydrocarbons. The reformate obtained in this manner has a density of 0.78 to 0.81 g/cm$^3$, a research octane number of 96 to 104 and a motor octane number of 86 to 89, and includes an aromatic fraction of 50 to 70% by volume and a saturated hydrocarbons content of 30 to 50% by volume.

Subsequently, a fractionator is used to separate the reformate into a light reformate containing mainly hydrocarbons having a carbon number of 5, and a C6+ fraction. The C6+ fraction contains mainly aromatic hydrocarbons having a carbon number of 6 or greater, but also includes other components such as saturated hydrocarbons having a carbon number of 6 or greater, olefin-based hydrocarbons and naphthene-based hydrocarbons. Each of the various components contained within the light reformate and the C6+ fraction can be determined by GC (gas chromatography) analysis (JIS K2536 "Liquid petroleum products—Testing method of components") or the like.

There are no particular limitations on the conditions used for separating the light reformate and the C6+ fraction, provided the separation can be performed without incorporating benzene within the light reformate. For example, the conditions may be selected appropriately so that the amount of the C6+ fraction within the light reformate is not more than 30% by volume.

The light reformate obtained in this manner contains 5 to 15% by volume of butane, 60 to 80% by volume of pentane, and 5 to 30% by volume of hexane. Here, the terms butane, pentane and hexane may also refer to mixtures of the normal paraffin and isoparaffin of carbon numbers 4, 5 and 6 respectively.

When extracting the solvent deasphalted pitch from the residue using the light reformate as a solvent, the residue and solvent are first mixed together using a mixing unit such as a mixer within the solvent deasphalting unit, and the mixture is then supplied to an asphaltene separation tank of the solvent deasphalting unit that is maintained at predetermined conditions, including a pressure that is not less than the critical pressure of the solvent and a temperature that is not higher than the critical temperature. Inside the asphaltene separation tank, the asphalt contained within the residue settles out. This sediment is discharged continuously from the bottom of the asphaltene separation tank, and the small amount of solvent contained within the discharged sediment is removed using a stripper. This process yields a solvent deasphalted pitch that can be used as a caking additive for coke production. The oil discharged from the top of the asphaltene separation tank is used as a deasphalted oil (DAO).

When extracting the solvent deasphalted pitch from the residue using the light reformate as a solvent, the extraction is preferably performed using an extraction temperature within a range from 150 to 200° C., and a flow rate ratio of the solvent relative to the residue (solvent/oil ratio) within a range from 5/1 to 8/1.

The residue extraction temperature is selected appropriately in accordance with the properties of the residue, and is adjusted so as to achieve a constant softening point for the solvent deasphalted pitch. If the extraction temperature is less than 150° C., then the softening point of the solvent deasphalted pitch increases to 200° C. or more, and extracting the caking additive for coke production from the solvent deasphalting unit becomes problematic. This causes a deterioration in the productivity and yield of the caking additive for coke production. If the extraction temperature exceeds 200° C., then the softening point of the solvent deasphalted pitch decreases to 140° C. or lower, which is undesirable from a handling perspective, making blending of the pitch with the raw material coal more difficult, and increasing the danger of fusing in a hot coal storage yard.

Furthermore, if the flow rate ratio of the solvent relative to the residue (solvent/oil ratio) is less than 5/1, then because the amount of solvent is small, the extraction efficiency in the asphaltene separation tank tends to decrease, and the softening point of the solvent deasphalted pitch decreases to 140° C. or lower, which is undesirable from a handling perspective, making blending of the pitch with the raw material coal more difficult, and increasing the danger of fusing in a hot coal storage yard. If the flow rate ratio of the solvent relative to the residue (solvent/oil ratio) exceeds 8/1, then an unnecessarily large volume of solvent must be refluxed, which increases the energy consumption of the solvent deasphalting unit, resulting in uneconomic operation of the unit.

The solvent deasphalted pitch obtained in this manner has a softening point of 140 to 200° C., the amount of carbon residue within the solvent deasphalted pitch (carbon residue) is within a range from 30 to 70% by mass, and the atomic ratio of hydrogen to carbon (H/C) is not more than 1.2.

In this description, the softening point refers to the value measured in accordance with JIS K2207 "Petroleum asphalts—Softening point test method (ring and ball method)". The amount of carbon residue (carbon residue) refers to the value measured in accordance with JIS K2270 "Crude petroleum and petroleum products—Determination of carbon residue". The atomic ratio of hydrogen to carbon (H/C) refers to the value measured in accordance with ASTM D5291 "Standard test methods for instrumental determination of carbon, hydrogen and nitrogen in petroleum products and lubricants".

In this type of solvent deasphalted pitch, because the amount of low-softening point light paraffins is sufficiently small and the volatile matter is sufficiently minimal, when the deasphalted pitch is used as a caking additive for coke production, excellent binding properties are obtained.

Furthermore, in the production process of the present embodiment illustrated in FIG. 1, coke is produced by using a coke oven to perform dry distillation of a raw material coal for coke production containing the caking additive for coke production obtained in the manner described above, a non-caking coal or slightly caking coal, and a caking coal.

The raw material coal for coke production preferably contains at least 0.5% by mass of the caking additive for coke production, and more preferably 1% by mass or more. Further, the amount of the caking additive for coke production contained within the raw material coal for coke production is preferably not more than 10% by mass, and more preferably 5% by mass or less.

In those cases where the raw material coal for coke production contains 0.5 to 10% by mass of the caking additive for coke production, the addition of the caking additive can increase the strength of the coke even if the proportion of non-caking coal or slightly caking coal included within the raw material coal for coke production is within a range from 10 to 50% by mass.

In order to ensure that the effects of adding the caking additive of the present invention are adequately realized, the amount of non-caking coal or slightly caking coal included within the raw material coal for coke production is preferably at least 10% by mass, and more preferably 15% by mass or greater. Further, the amount of non-caking coal or slightly caking coal included within the raw material coal for coke production is preferably not more than 50% by mass, and more preferably 40% by mass or less.

Provided the of amount of non-caking coal or slightly caking coal included within the raw material coal for coke production satisfies the range mentioned above, the strength of the coke can be increased by addition of the caking additive, and the amount of strongly caking coal within the raw material coal for coke production can be reduced while maintaining the coke strength.

With the process for producing a caking additive for coke production according to the present embodiment, unlike thermal decomposition processes, modification of the asphaltenes due to thermal decomposition reactions does not occur. Accordingly, a superior caking additive for coke production that enables the coke strength to be effectively increased can be obtained. Furthermore, in the process for producing a caking additive for coke production according to the present embodiment, because the solvent deasphalted pitch is extracted from the residue using a light reformate as the solvent, a favorable caking additive for coke production having a minimal volatile matter can be produced with good yield.

Furthermore, according to the process for producing coke of the present embodiment, a large amount of non-caking coal or slightly caking coal can be added to the raw material coal for coke production, and yet a high-strength coke can still be obtained, and therefore the amount of strongly caking coal within the raw material coal for coke production can be reduced.

In other words, in the process for producing coke according to the present embodiment, because the raw material coal for coke production contains the caking additive for coke production of the present embodiment, the caking additive for coke production is able to improve the adhesion between coal particles during dry distillation of the raw material coal for coke production, as well as promoting the development of optically anisotropic structures during the co-carbonization reaction with coal. This improves the coke strength.

EXAMPLES

Next is a description of examples of the present invention. The following examples are used merely to confirm the effects of the present invention, and the present invention is in no way limited by these examples. The present invention may employ all manner of conditions, provided these conditions do not depart from the scope of the invention and enable the objects of the present invention to be achieved.

An atmospheric residue was obtained by subjecting a crude oil to atmospheric distillation in an atmospheric distillation unit used in the crude oil refining process illustrated in FIG. 1, and a vacuum residue was then obtained by subjecting this atmospheric residue to vacuum distillation in a vacuum distillation unit. Using the solvent shown in Table 1, a solvent deasphalted pitch was then extracted from the vacuum residue. In this example, this solvent deasphalted pitch was used as a caking additive for coke production (A and B in Table 1).

Furthermore, an atmospheric residue was obtained by subjecting a crude oil to atmospheric distillation in an atmospheric distillation unit used in the crude oil refining process, and a vacuum residue was then obtained by subjecting this atmospheric residue to vacuum distillation in a vacuum distillation unit. A Eureka pitch was then obtained by subjecting the vacuum residue to thermal decomposition in a Eureka process. In this example, this Eureka pitch (a commercially available petroleum-based pitch) was used as a caking additive for coke production (C in Table 1).

For each of these caking additives for coke production A to C obtained in the manner described above, the results of industrial analysis of the density, softening point and carbon residue, the results of proximate analysis, the results of elemental analysis, and the results of component analysis are listed in Table 1, together with the test methods employed.

TABLE 1

| Extraction solvent | | | Test method | | Light reformate | Butane (C4) | Eureka pitch * |
|---|---|---|---|---|---|---|---|
| Density @ 15° C. | | g/cm$^3$ | JIS K2207 | Petroleum asphalts - Density test method | 1.15 | 1.13 | 1.21 |
| Softening point | | ° C. | JIS K2207 | Petroleum asphalts - Softening point test method | 179 | 138 | 226 |
| Carbon residue | | mass % | JIS K2270 | Crude petroleum and petroleum products - Determination of carbon residue | 51.4 | 43.5 | — |
| Proximate analysis | Ash content | mass % | JIS M8812 | Coal and coke - Methods for proximate analysis | 0.1 | 0.1 | 0.2 |
| | Volatile matter | mass % | JIS M8812 | Coal and coke - Methods for proximate analysis | 55.5 | 63.0 | 40.0 |
| | Fixed carbon | mass % | JIS M8812 | Coal and coke - Methods for proximate analysis | 40.4 | 33.0 | 59.5 |
| Elemental analysis | C | mass % | ASTM D5291 | Standard test methods for instrumental determination of carbon, hydrogen and nitrogen in petroleum products and lubricants | 82.9 | 82.8 | 85.6 |
| | H | mass % | ASTM D5291 | As above | 8.2 | 8.7 | 6.2 |
| | N | mass % | ASTM D5291 | As above | 0.8 | 0.8 | 1.2 |
| | S | mass % | ASTM D5291 | As above | 7.5 | 7.0 | 5.7 |
| | H/C ratio | | as per ASTM D5291 | As above | 1.18 | 1.26 | 0.87 |
| Component analysis | Saturated hydrocarbons content | mass % | JPI-5S-22 | Fractional Analysis for Asphaltic Bitumen by Column Chromatography | 0.1 | 3.2 | 2.2 |
| | Aromatic hydrocarbons content | mass % | JPI-5S-22 | Fractional Analysis for Asphaltic Bitumen by Column Chromatography | 11.4 | 20.5 | 18.1 |
| | Resins | mass % | JPI-5S-22 | Fractional Analysis for Asphaltic Bitumen by Column Chromatography | 17.4 | 19.8 | 14.3 |
| | Asphaltenes | mass % | JPI-5S-22 | Fractional Analysis for Asphaltic Bitumen by Column Chromatography | 71.1 | 56.5 | 4.5 |
| | Toluene-insoluble fraction | mass % | JPI-5S-22 | Fractional Analysis for Asphaltic Bitumen by Column Chromatography | 0.0 | 0.0 | 60.9 |
| Caking additive for coke production | | | | | A | B | C |

* Commercially available petroleum-based pitch obtained from the Eureka process

Of the solvents shown in Table 1, the light reformate contained 7% by volume of butane (a mixture of normal butane and isobutane), 66% by volume of pentane (a mixture of normal pentane and isopentane), and 27% by volume of hexane (a mixture of normal hexane and isohexane).

As is evident from Table 1, the softening point of the caking additive for coke production A that was prepared using the light reformate as the solvent was higher than that of the caking additive for coke production B prepared using butane as the solvent, but lower than that of the caking additive for coke production C composed of the Eureka pitch, and satisfied the preferred range for caking additives for coke production.

Furthermore, the caking additive for coke production A also exhibited a carbon residue and an atomic ratio of hydrogen to carbon (H/C ratio) that satisfied the respective preferred ranges for caking additives for coke production.

Subsequently, using a coke oven, a coke of a comparative example 1 was produced by performing a dry distillation of a raw material coal for coke production containing 20% by mass of a non-caking coal or slightly caking coal and 80% by mass of a caking coal.

Further, cokes of an example 1 and a reference example 1 were produced by adding 5% by mass of the caking additive for coke production A or the caking additive for coke production C shown in Table 1 to the raw material coal for coke production used in the production of the coke of comparative example 1, and subsequently performing a dry distillation.

TABLE 2

| | Example 1 | Comparative Example 1 | Reference Example 1 |
|---|---|---|---|
| Caking additive | A | — | C |
| Caking additive blend ratio (% by mass) | 5 | 0 | 5 |
| Coke strength after Reaction (CSR) | 60.0 | 54.4 | 57.1 |
| Abrasion strength (%) | 86.2 | 85.6 | 86.5 |

The cokes of example 1, comparative example 1 and reference example 1 obtained in the manner described above were each measured for coke strength after $CO_2$ reaction (CSR) and abrasion strength. The results are shown in Table 2.

The CSR is measured using the following method. Namely, 200 g of coke having a grain size of 20 mm was reacted for 2 hours with $CO_2$ gas at a high temperature of 1,100° C., and the rotational strength of the reacted coke was then measured at room temperature using an I-type drum.

The abrasion strength was evaluated by sealing 200 g of coke having a granular diameter of 20 mm inside a steel circular cylinder having a diameter of 130 mm and a length of 700 mm, rotating the cylinder at a rotational speed of 20 rpm for 600 revolutions, and then measuring the weight percentage of coke retained on a 9.5 mm mesh.

From Table 2 it is evident that the coke of example 1 which used the caking additive for coke production A obtained using the light reformate as a solvent exhibited a higher CSR value than either the coke of comparative example 1 which used no caking additive for coke production, or the coke of reference example 1 which used the caking additive for coke production C composed of Eureka pitch. It is thought that this result is due to that fact that, in the coke of example 1, the carbon substrate was reformed during the coal softening and carbonization that occurred due to the presence of the caking additive for coke production obtained using the light reformate as a solvent, and this resulted in an improvement in the strength of the coke carbon substrate.

Further, it was also confirmed that the coke of example 1 that used the caking additive for coke production A exhibited superior abrasion strength compared with the coke of comparative example 1 that did not use a caking additive for coke production.

Next, each of caking additives for coke production A to C shown in Table 1 were evaluated for fluidity, which is an important factor in terms of improving the cold strength of the coke. The results are shown in Table 3.

Evaluation of the fluidity was performing using the following method. Namely, using a non-caking coal or slightly caking coal as a base coal, 5% by mass of each of the caking additives for coke production A to C was added to the base coal, a fluidity evaluation test was performed in accordance with the Gieseler Plastometer method (JIS M 8801), and the maximum fluidity (MF) was determined. The caking additive apparent MF (log-ddpm (dial division per minute)) and the degree of expansion in the fluid temperature range (%) were determined.

TABLE 3

| Caking additive | A | B | C |
|---|---|---|---|
| Apparent MF (log-ddpm) | 7.9 | 6.8 | 6.2 |
| Expansion in fluid temperature range (%) | 13.7 | 2.4 | 9.5 |

The caking additive apparent MF (log-ddpm) represents the apparent maximum fluidity of the caking additive for coke production, and is determined using the formula below.

Caking additive apparent MF=((maximum fluidity of base coal containing added caking additive−maximum fluidity of base coal)×base coal content)/caking additive content Further, the degree of expansion in the fluid temperature range (%) describes the degree of expansion (%) in the fluid temperature range from the fluid temperature range of the base coal (solidification temperature−softening start temperature) upon addition of the caking additive for coke production.

As shown in Table 3, it was found that compared with the caking additive for coke production B obtained using butane as a solvent and the caking additive for coke production composed of Eureka pitch, the caking additive for coke production A obtained using the light reformate as a solvent exhibited a larger caking additive apparent MF (log-ddpm) and a larger expansion (%) in the fluid temperature range, indicating a superior effect in increasing the fluidity and fluid temperature range.

The main reason for the broadening of the fluid temperature range was a reduction in the softening start temperature, and it is surmised that the difference in the fluid temperature ranges for the caking additives for coke production A to C is due to the difference in asphaltene content within the caking additives.

INDUSTRIAL APPLICABILITY

As described above, the present invention enables the production of a high-strength coke even when the blend proportion of non-caking coal or slightly caking coal is increased, and therefore offers a high degree of industrial applicability.

The invention claimed is:

1. A caking additive for coke production consisting of a solvent deasphalted pitch, wherein the caking additive for coke production has a softening point within a range from 179 to 200° C., an amount of carbon residue within a range from 30 to 70% by mass, and an atomic ratio of hydrogen to carbon of not more than 1.2.

2. A caking additive for coke production according to claim 1, wherein the solvent deasphalted pitch is sediment extracted by using a light reformate containing 5 to 15% by volume of butane, 60 to 80% by volume of pentane, and 5 to 30% by volume of hexane as a solvent.

3. A coke comprising a caking additive for coke production according to claim 1.

4. A caking additive for coke production according to claim 1 and produced by a process for producing a caking additive, the process comprising:

a step of extracting the solvent deasphalted pitch that can be used as the caking additive for coke production from a residue comprising at least one of an atmospheric residue obtained by atmospheric distillation of a crude oil and a vacuum residue obtained by atmospheric distillation and vacuum distillation of a crude oil, wherein the extracting is performed using, as a solvent, a light reformate obtained by catalytic reforming a naphtha fraction that is fractionated from crude oil by atmospheric distillation of the crude oil.

5. A caking additive for coke production according to claim 4, wherein the light reformate contains 5 to 15% by volume of butane, 60 to 80% by volume of pentane, and 5 to 30% by volume of hexane.

6. A caking additive for coke production according to claim 4, wherein the step of extracting is performed using an extraction temperature within a range from 150 to 200° C., and a flow rate ratio between the solvent and the residue (solvent/residue) within a range from 5/1 to 8/1.

7. A coke comprising a caking additive for coke production according to claim 4.

8. A process for producing coke, the process comprising:

a step of extracting a solvent deasphalted pitch that can be used as a caking additive for coke production from a residue comprising at least one of an atmospheric residue obtained by atmospheric distillation of a crude oil and a vacuum residue obtained by atmospheric distillation and vacuum distillation of a crude oil, wherein the extracting is performed using, as a solvent, a light reformate obtained by catalytic reforming a naphtha fraction that is fractionated from a crude oil by atmospheric distillation of the crude oil, and a step of producing a coke by performing dry distillation of a raw material coal for coke production that comprises the solvent deasphalted pitch, wherein the caking additive for coke production has a softening point within a range from 179 to 200° C., an amount of carbon residue within a range from 30 to 70% by mass, and an atomic ratio of hydrogen to carbon of not more than 1.2.

9. The process for producing coke according to claim 8, wherein the raw material coal for coke production comprises 0.5 to 10% by mass of the solvent deasphalted pitch.

10. The process for producing coke according to claim 8, wherein the raw material coal for coke production comprises 10 to 50% by mass of a non-caking coal or slightly caking coal.

11. The process for producing coke according to claim 9, wherein the raw material coal for coke production comprises 10 to 50% by mass of a non-caking coal or slightly caking coal.

* * * * *